US010086423B2

(12) United States Patent
Shimizu et al.

(10) Patent No.: US 10,086,423 B2
(45) Date of Patent: Oct. 2, 2018

(54) METHOD FOR FORMING A PRESSED COMPONENT

(71) Applicant: Kabushiki Kaisha F.C.C., Hamamatsu-shi, Shizuoka (JP)

(72) Inventors: Yuki Shimizu, Hamamatsu (JP); Yutaka Touda, Hamamatsu (JP)

(73) Assignee: Kabushiki Kaisha F.C.C., Hamamatsu-shi (JP)

( * ) Notice: Subject to any disclaimer, the term of this patent is extended or adjusted under 35 U.S.C. 154(b) by 593 days.

(21) Appl. No.: 14/759,833

(22) PCT Filed: Dec. 19, 2013

(86) PCT No.: PCT/JP2013/084105
§ 371 (c)(1),
(2) Date: Jul. 8, 2015

(87) PCT Pub. No.: WO2014/109201
PCT Pub. Date: Jul. 17, 2014

(65) Prior Publication Data

US 2015/0352622 A1 Dec. 10, 2015

(30) Foreign Application Priority Data

Jan. 11, 2013 (JP) ..... 2013-004112

(51) Int. Cl.
*B21C 23/00* (2006.01)
*B21D 28/28* (2006.01)
(Continued)

(52) U.S. Cl.
CPC ..... *B21D 28/28* (2013.01); *B21D 22/00* (2013.01); *B21D 35/001* (2013.01); *B21D 53/34* (2013.01)

(58) Field of Classification Search
CPC ..... B21D 28/28; B21D 35/001; B21D 53/34; B21D 22/00; B21D 7/004
(Continued)

(56) References Cited

U.S. PATENT DOCUMENTS 2,898,788 A * 8/1959 Baxa ..... B21C 37/292 470/197
4,245,491 A * 1/1981 Kondo ..... B21D 22/04 72/254
(Continued)

FOREIGN PATENT DOCUMENTS

CN 1096974 A 1/1995
CN 1099678 A 3/1995
(Continued)

*Primary Examiner* — David B Jones
(74) *Attorney, Agent, or Firm* — Michael Tobias

(57) ABSTRACT

A pressed component is formed by pressing a preform having a tapered tubular portion and a sloping portion provided at an end of the tubular portion and curved in a circular arc. Pressing is performed by a forming die apparatus including a holding body, a piercing punch, and a piercing die. When the tubular portion of the preform is held by an outer fixing and supporting portion of the holding body and an inner fixing and supporting portion of the piercing die, the forming die apparatus cuts off a portion of the sloping portion using an outer cutting edge of the piercing punch and an inner cutting edge of the piercing die and then causes a pressing portion of the piercing punch to bend and press the remaining portion of the sloping portion within a forming space to form a corner portion.

16 Claims, 5 Drawing Sheets

(51) Int. Cl.
*B21D 22/00* (2006.01)
*B21D 53/34* (2006.01)
*B21D 35/00* (2006.01)

(58) Field of Classification Search
USPC ..... 72/327
See application file for complete search history.

(56) References Cited

U.S. PATENT DOCUMENTS

| | | | | |
|---|---|---|---|---|
| 4,427,397 | A * | 1/1984 | Endo | H01J 9/02 445/49 |
| 7,171,838 | B2 * | 2/2007 | Shiokawa | B21D 22/02 72/347 |
| 7,624,611 | B2 * | 12/2009 | Saitou | B21D 22/20 72/348 |
| 2015/0336155 | A1 | 11/2015 | Kawai et al. | |

FOREIGN PATENT DOCUMENTS

| | | |
|---|---|---|
| JP | 06218442 | 8/1994 |
| JP | 07032068 | 2/1995 |
| JP | 2004358553 | 12/2004 |

* cited by examiner (A)

(B)

(A)

(B)

(C)

(D)

METHOD FOR FORMING A PRESSED COMPONENT

TECHNICAL FIELD

The present invention relates to a method for forming a pressed metal component including a tubular member having one end portion bent inward to have a cup-like shape, a method for manufacturing such a pressed component, and a die apparatus for forming such a pressed component.

BACKGROUND ART

In general, cup-shaped pressed metal components having a roughly U-shaped cross section, such as a clutch guide, an end plate, a clutch piston, or a cup for a plate carrier, are used in a power transmission apparatus mounted on an automobile, a motorcycle, or the like. These pressed components are typically formed by drawing, stretch flanging, upsetting, blanking, and cutting.

For example, below-described Patent Document 1 discloses a method for forming a pressed component in which after a plate-shaped blank is formed into a cup-shaped intermediate product by deep drawing, an edge portion of the cup-shaped intermediate product is upset through compression thereof so as to increase the thickness of the edge portion including a corner portion thereof.

PRIOR ART DOCUMENTS

Patent Documents

Patent Document 1: JP H06-218442 A

However, in the method for forming a pressed component described in Patent Document 1, a large compressive load is required to form the pressed component. Therefore, the conventional method involves the problem that equipment including a die apparatus becomes large and complex. Namely, in the conventional pressed component forming method disclosed in Patent Document 1, after an edge portion of a plate-shaped blank is bent and a tapered surface is formed at the distal end of the bent edge portion, the bent edge portion is pressed and crushed along the direction in which the bent edge portion extends so that the bent edge portion plastically deforms while buckling. Therefore, the conventional method requires a structure for applying a very large compressive load for plastic deformation and a structure for withstanding that compressive load. Accordingly, the conventional method has the problem that it leads to an increase in the size and the degree of complexity of equipment used for forming a pressed component.

The present invention was made in order to cope with the above-described problems, and its object is to provide a method for forming a pressed component, a method for manufacturing a pressed component, and a die apparatus for forming a pressed component which can reduce the load necessary for forming to thereby decrease the size and the degree of complexity of equipment used for forming a pressed component.

SUMMARY OF THE INVENTION

In order to achieve the above object, the present invention provides a method for forming a pressed metal component having a tubular body, one end of which is bent inward to form a cup-like shape. The method being characterized by comprising a step of preparing a preform having a tubular portion and a sloping portion provided at an end of the tubular portion and sloping with respect to the tubular portion; a step of preparing a piercing punch which is disposed outside the sloping portion of the preform and which has an outer cutting edge for cutting off a portion of the sloping portion of the preform and a pressing portion for pressing the remaining portion of the sloping portion; a step of preparing a piercing die which is disposed inside the sloping portion of the preform and which has an inner cutting edge for cutting off the portion of the sloping portion in cooperation with the outer cutting edge, a receiving portion for receiving the sloping portion pressed by the pressing portion within a forming space between the receiving portion and the sloping portion, an inner extension restricting portion for restricting lengthwise extension of the sloping portion pressed by the pressing portion, and an inner fixing and supporting portion for fixedly supporting the tubular portion; a step of preparing a holding body which is disposed outside the sloping portion of the preform and which has an outer extension restricting portion for restricting lengthwise extension of the sloping portion pressed by the pressing portion and an outer fixing and supporting portion for fixedly supporting the sloping portion; and a corner portion forming step of causing the piercing punch and the piercing die to move relative to each other in a state in which the preform is fixedly supported by the piercing die and the holding body so as to cut off a portion of the sloping portion and bend and press the remaining portion of the sloping portion to thereby form a corner portion.

According to the feature of the method for forming a pressed component according to the present invention, a preform having a tubular portion and a sloping portion extending from one end of the tubular portion is used. A portion of the sloping portion is cut off, and the remaining portion is bent toward the piercing die within the forming space and is then compressed so as to form the corner portion. Namely, in the method for forming a pressed component according to the present invention, instead of pressing and crushing a portion (the sloping portion) of the preform which becomes the corner portion such that that portion (the sloping portion) plastically deforms while buckling, the remaining portion is pressed in a direction intersecting the direction in which the sloping portion extends so as to bend the remaining portion. Therefore, it is possible to form the corner portion while increasing its thickness with a smaller force compared with the conventional technique. As a result, the forming die apparatus and die equipment including the forming die apparatus can be made small and simple.

When the method for forming a pressed component according to the present invention is employed, it is unnecessary to form a tapered surface on the peripheral edge of a blank as in the case of the above-described conventional technique. Therefore, a die for forming a tapered surface, die equipment including such a die, and a step of forming a tapered surface become unnecessary. Also, in the method for forming a pressed component according to the present invention, a portion (a sloping portion) of the preform which becomes the corner portion is pressed while being bent. Therefore, the corner portion can be accurately formed without causing folding of the material. The cup-like shape of the pressed component refers to the shape of a tubular member which is bent inward at at least one end thereof so as to form a bottom and which has a circular or non-circular through hole formed in the bottom.

A second feature of the present invention is that the sloping portion of the preform extends from the tubular portion while bending smoothly in a curved shape.

According to the second feature of the method for forming a pressed component according to the present invention, the sloping portion of the preform extends from the tubular portion while bending smoothly in a curved shape. This avoids the occurrence of a portion in which stress concentrates when the corner portion is formed. Thus, it becomes possible to form the corner portion by plastically deforming the sloping portion while effectively preventing folding or curling of the sloping portion. Also, since the sloping portion of the preform is formed in a curved shape, it is possible to prevent a decrease in the thickness (so-called thinning) of the sloping portion during formation of the sloping portion. As a result, it is possible to effectively prevent thinning of the corner portion of the pressed component. The greater the radius of curvature of the sloping portion of the preform, the greater the degree to which thinning of the corner portion of the pressed component can be prevented.

A third feature of the present invention is that the tubular portion of the preform is tapered such that its diameter decreases toward the sloping portion.

According to the third feature of the method for forming a pressed component according to the present invention, the tubular portion of the preform is tapered such that its diameter decreases toward the sloping portion. Therefore, the inner fixing and supporting portion of the piercing die and the outer fixing and supporting portion of the holding body which fixedly support the preform can have a tapered shape corresponding to the tapered shape of the tubular portion. Thus, an operation of causing the piercing die and the holding body to approach each other and separate from each other can be realized by displacement along a single axis. As a result, the preform can be supported easily and accurately, and the size and the degree of complexity of equipment can be decreased.

The present invention can be implemented not only as a method for forming a pressed component but also as a method for manufacturing a pressed component and a die apparatus for forming a pressed component.

Specifically, the method for manufacturing a pressed component is preferably a method for manufacturing a pressed metal component having a tubular body, one end of which is bent inward to form a cup-like shape, the method comprising: a step of preparing a preform having a tubular portion and a sloping portion provided at an end of the tubular portion and sloping with respect to the tubular portion; a step of preparing a piercing punch which is disposed outside the sloping portion of the preform and which has an outer cutting edge for cutting off a portion of the sloping portion of the preform and a pressing portion for pressing the remaining portion of the sloping portion; a step of preparing a piercing die which is disposed inside the sloping portion of the preform and which has an inner cutting edge for cutting off the portion of the sloping portion in cooperation with the outer cutting edge, a receiving portion for receiving the sloping portion pressed by the pressing portion within a forming space between the receiving portion and the sloping portion, an inner extension restricting portion for restricting lengthwise extension of the sloping portion pressed by the pressing portion, and an inner fixing and supporting portion for fixedly supporting the tubular portion; a step of preparing a holding body which is disposed outside the sloping portion of the preform and which has an outer extension restricting portion for restricting lengthwise extension of the sloping portion pressed by the pressing portion and an outer fixing and supporting portion for fixedly supporting the sloping portion; and a corner portion forming step of causing the piercing punch and the piercing die to move relative to each other in a state in which the preform is fixedly supported by the piercing die and the holding body so as to cut off a portion of the sloping portion and bend and press the remaining portion of the sloping portion to thereby form a corner portion.

The die apparatus for forming a pressed metal component is preferably a die apparatus for forming a pressed metal component having a tubular body, one end of which is bent inward to form a cup-like shape, the pressed metal component being formed from a preform having a tubular portion and a sloping portion provided at an end of the tubular portion and sloping with respect to the tubular portion, and the die apparatus comprising a piercing punch which is disposed outside the sloping portion of the preform and which has an outer cutting edge for cutting off a portion of the sloping portion of the preform and a pressing portion for pressing the remaining portion of the sloping portion; a piercing die which is disposed inside the sloping portion of the preform and which has an inner cutting edge for cutting off the portion of the sloping portion in cooperation with the outer cutting edge, a receiving portion for receiving the sloping portion pressed by the pressing portion within a forming space between the receiving portion and the sloping portion, an inner extension restricting portion for restricting lengthwise extension of the sloping portion pressed by the pressing portion, and an inner fixing and supporting portion for fixedly supporting the tubular portion; and a holding body which is disposed outside the sloping portion of the preform and which has an outer extension restricting portion for restricting lengthwise extension of the sloping portion pressed by the pressing portion and an outer fixing and supporting portion for fixedly supporting the sloping portion.

Actions and effects similar to those provided by the above-described method for forming a pressed component can be expected from the manufacturing method and the die apparatus.

BRIEF DESCRIPTION OF THE DRAWINGS

FIGS. 3(A) and 3(B) are cross-sectional views used for describing the steps of the pressed component-forming method according to an embodiment of the present invention, wherein FIG. 3(A) is a cross-sectional view showing a state in which a preform is set on a forming die apparatus, and FIG. 3(B) is a cross-sectional view showing a state in which a piercing punch is compressing the preform after having cut the preform.

MODES FOR CARRYING OUT THE INVENTION

Figure 1:
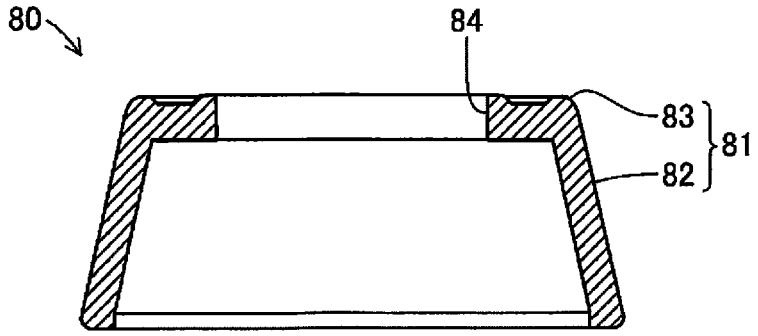
FIG. 1 is a cross-sectional view schematically showing the structure of a pressed component formed by a method for forming a pressed component (referred to below as a "pressed component-forming method") according to the present invention.

One embodiment of a pressed component-forming method according to the present invention will be described below with reference to the drawings. FIG. 1 is a cross-sectional view schematically showing the structure of a pressed component 80 formed by the pressed component-forming method according to the present invention. The figures referred to in the description are schematically illustrated with some components exaggerated in order to facilitate an understanding of the present invention. Therefore, components shown in the drawings may have dimensions, proportions, etc. which are different from the actual ones.

First, the pressed component 80 formed by the pressed component-forming method according to the present invention will be briefly described. The pressed component 80 is a component which is used as a clutch guide, an end plate, a clutch piston, or a cup for a plate carrier of a clutch mounted on a vehicle such as an automobile or a motorcycle. The pressed component 80 is a tubular member formed by pressing a plate of steel such as carbon steel (e.g., SPCC, SPCD, SPCE, or S35C) or high-tensile steel. More specifically, the pressed component 80 includes a tubular main body 81 which has a tubular portion 82 having a tapered outer periphery and a corner portion 83 formed by bending one end portion (located on the upper side in FIG. 1) of the tubular portion 82 inward with respect to the main body 81 at a right angle. A punched hole (through hole) 84 is formed in the pressed component 80 on the radially inner side of the corner portion 83.

(Structure of Forming Die Apparatus 100)

Figure 2:
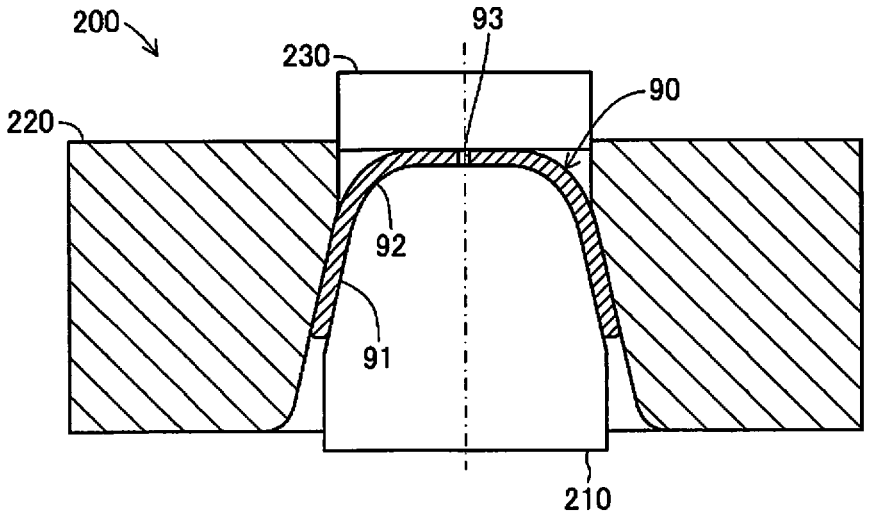
FIG. 2 is a cross-sectional view schematically showing the structure of a preform used in a pressed component-forming method according to an embodiment of the present invention and schematically showing the structure of a die apparatus for preforming used for forming the preform.

A forming die apparatus 100 for forming the pressed component 80 using the pressed component-forming method according to the present invention will be described. The forming die apparatus 100 is a metallic die for forming the pressed component 80 by pressing a preform 90. The preform 90 is a semi-processed product from which the pressed component 80 is formed by the forming die apparatus 100. Specifically, as shown in FIG. 2, the preform 90 has the shape of a tube with a bottom. The preform 90 is mainly composed of a tapered tubular portion 91 and a sloping portion 92 which is continuous with the end of the tubular portion 91 on the smaller diameter side, bends inward to form a curved shape, and then extends horizontally. A positioning hole 93 (through hole) is formed at the center of the horizontal portion of the sloping portion 92 of the preform 90.

Figure 3:
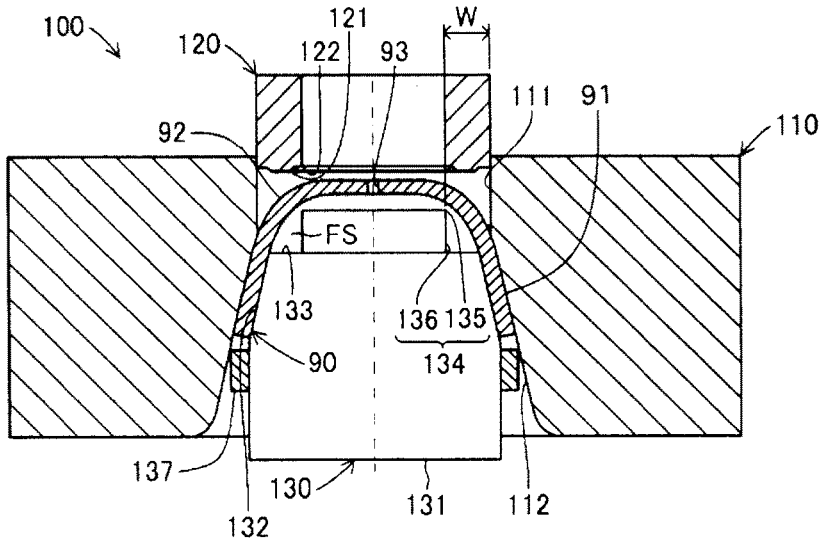
Figure 3:
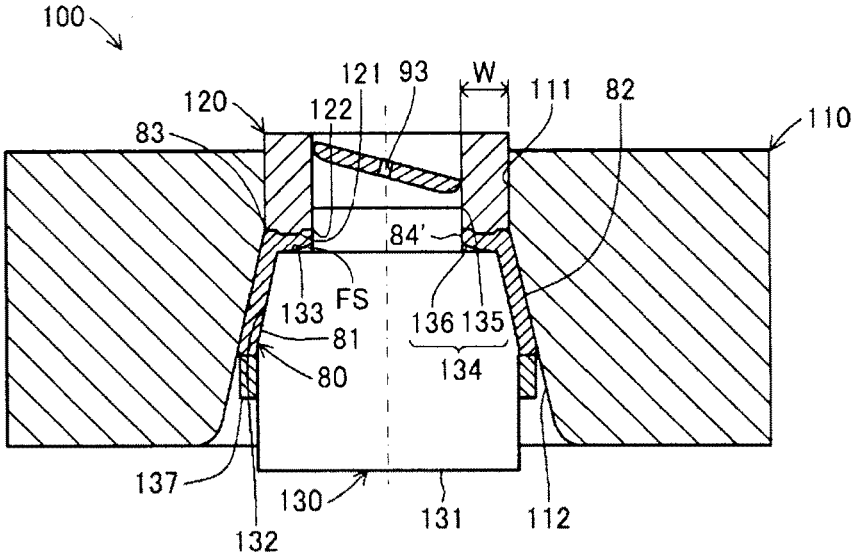

As shown in FIGS. 3(A) and 3(B), the forming die apparatus 100 is mainly composed of a holding body 110, a piercing punch 120, and a piercing die 130.

The holding body 110 is a die which fixedly supports the preform 90 in cooperation with the piercing die 130 and forms the pressed component 80 in cooperation with the piercing punch 120 and the piercing die 130. The holding body 110 is formed of die steel and has a generally cylindrical shape. More specifically, the holding body 110 has an outer extension restricting portion 111 and an outer fixing and supporting portion 112 which define a through hole formed at the center.

The outer extension restricting portion 111 is a hollow cylindrical portion which forms a wall for guiding the piercing punch 120 to be described later and for preventing the sloping portion 92 which remains after cutting by an outer cutting edge 122 and an inner cutting edge 135 which will be described later from plastically deforming in such a manner that the sloping portion 92 extends toward the radially outer side of the tubular portion 91. The outer extension restricting portion 111 has an inner diameter corresponding to the outer diameter of the corner portion 83 of the pressed component 80. The outer fixing and supporting portion 112 is a tapered hollow portion which presses the tubular portion 91 of the preform 90 from the outside of the tubular portion 91 so as to fixedly support the preform 90 in cooperation with the piercing die 130. The outer fixing and supporting portion 112 has a tapered shape corresponding to the tapered shape of the tubular portion 91 of the preform 90.

The piercing punch 120 is a die which cooperates with the piercing die 130 and the holding body 110 so as to cut and press the preform 90, thereby forming the pressed component 80. The piercing punch 120 is formed of die steel and has a generally cylindrical shape. More specifically, the piercing punch 120 has an outer diameter corresponding to the outer diameter of the corner portion 83 of the pressed component 80. In other words, the piercing punch 120 has an outer diameter which allows the piercing punch 120 to fit into the outer extension restricting portion 111 of the holding body 110 and slide therein, and an inner diameter corresponding to the diameter of the punched hole 84 which is to be formed in the pressed component 80 inward of the corner portion 83.

The piercing punch 120 has a pressing portion 121 formed at its lower end facing the piercing die 130. The pressing portion 121 presses the sloping portion 92 of the preform 90 toward the piercing die 130 so as to plastically deform the sloping portion 92 to thereby form the corner portion 83 of the pressed component 80. The pressing portion 121 has a shape which is the complement of the shape of the outer surface of the corner portion 83. In the present embodiment, the pressing portion 121 has a convex shape corresponding to the concave outer surface of the corner portion 83. The outer cutting edge 122 for cutting the sloping portion 92 of the preform 90 so as to form the punched hole 84 of the pressed component 80 is formed along the inner edge of the ring-shaped pressing portion 121.

The piercing die 130 is a die which fixedly supports the preform 90 in cooperation with the holding body 110 and cuts and presses the preform 90 in cooperation with the piercing punch 120 and the holding body 110 to thereby form the pressed component 80. The piercing die 130 is formed of die steel and has a generally circular columnar shape. More specifically, the piercing die 130 is mainly composed of a die main body 131 and a protrusion 134. The die main body 131 is formed by a circular columnar member, and an inner fixing and supporting portion 132 is formed on an end portion of the circular columnar member on the side closer to the piercing punch 120.

The inner fixing and supporting portion 132 supports the tubular portion 91 of the preform 90 from the inner side of the tubular portion 91 so as to fixedly support the preform 90 in cooperation with the holding body 110. The inner fixing and supporting portion 132 has a tapered shape corresponding to the tapered shape of the tubular portion 91 of the preform 90. The protrusion 134 is formed on an end surface of the die main body 131 on the side closer to the piercing punch 120. The protrusion 134 has a diameter smaller than the outer diameter of the end surface of the die main body 131. A receiving portion 133 is formed on the end surface radially outward of the protrusion 134.

The receiving portion 133 is an annular portion which receives the sloping portion 92 of the preform 90 pressed by the piercing punch 120 and plastically deforms the sloping portion 92 to thereby form the corner portion 83 of the pressed component 80. The receiving portion 133 has a shape which is the complement of the shape of the inner surface of the corner portion 83. In the present embodiment, the receiving portion 133 has a flat shape corresponding to the flat shape of the inner surface of the corner portion 83 of the pressed component 80.

The protrusion 134 is a circular columnar portion for cutting off a portion of the sloping portion 92 of the preform 90 and for plastically deforming the remaining portion (the portion remaining after the cutting) of the sloping portion 92 to thereby form the corner portion 83 of the pressed component 80. More specifically, the protrusion 134 has the inner cutting edge 135 and an inner extension restricting portion 136 which are formed on the outer periphery thereof.

The inner cutting edge 135 cuts the sloping portion 92 of the preform 90 in cooperation with the outer cutting edge 122 to thereby form the punched hole 84 of the pressed component 80. The inner extension restricting portion 136 forms a wall for preventing the sloping portion 92 remaining after the cutting operation from plastically deforming in such a manner that the sloping portion 92 extends toward the radially inward side of the tubular portion 91. Namely, the width W of a forming space FS, which is an annular space between the outer extension restricting portion 111 of the holding body 110 and the inner extension restricting portion 136 of the protrusion 134, corresponds to the width of the corner portion 83 of the pressed component 80 in the radial direction.

A receiving and supporting body 137 is provided around the die main body 131 of the piercing die 130. The receiving and supporting body 137 is a die for receiving and supporting the lower end of the tubular portion 91 of the preform 90 when the preform 90 is plastically deformed so as to form the pressed component 80. The receiving and supporting body 137 is formed with an annular shape so that the receiving and supporting body 137 fixedly fits onto the outer periphery of the die main body 131.

The holding body 110, the piercing punch 120, and the piercing die 130, which constitute the forming die apparatus 100, are mounted on a press (not shown) for pressing the preform 90 so as to form the pressed component 80. The piercing die 130 including the receiving and supporting body 137 is secured to the press. The holding body 110 and the piercing punch 120 are provided within the press in coaxial relationship with the piercing die 130 such that they can move toward or away from the piercing die 130.

(Formation of Pressed Component 80)

Figure 4:
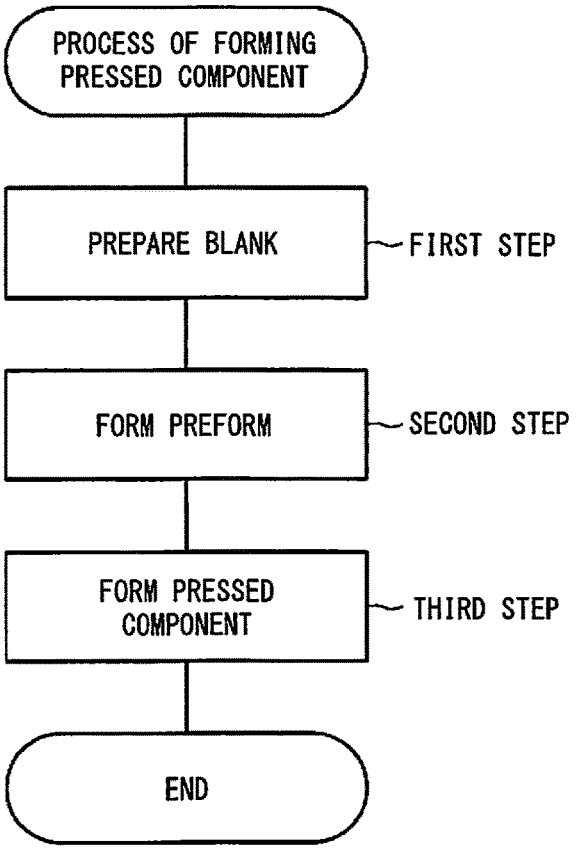
FIG. 4 is a flowchart showing the steps of a process of forming a pressed component by the pressed component-forming method according to an embodiment of the present invention.
Figure 5:
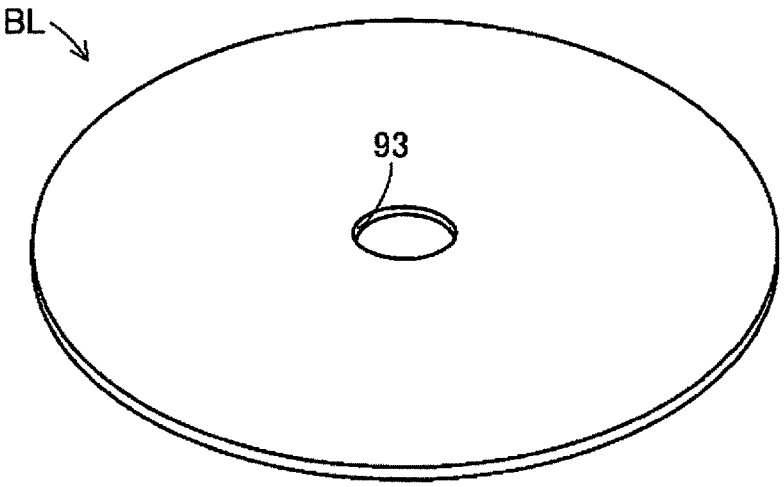
FIG. 5 is a perspective view schematically showing the appearance of a blank from which the preform used in the pressed component-forming method according to an embodiment of the present invention is formed.

Next, the operation of carrying out a pressed component-forming method by using the forming die apparatus 100 will be described with reference to a process flowchart shown in FIG. 4. In a first step, an operator prepares a blank BL. Specifically, as shown in FIG. 5, the operator prepares the blank BL by forming a positioning hole 93 at the center of a circular flat plate of steel such as carbon steel (e.g., SPCC, SPCD, SPCE, or S35C) or high-tensile steel using an unillustrated punching press. The positioning hole 93 formed in the blank BL is used for positioning of the preform 90 in a press which presses the preform 90. When the press does not require a positioning hole, the positioning hole 93 may be omitted (see FIG. 6(D)).

Next, in a second step, the operator forms the preform 90. As shown in FIG. 2, the preform 90 is a material from which the pressed component 80 is formed by the forming die apparatus 100, i.e., it is a semi-processed product which is formed by drawing the blank BL and which has a cup-like shape. Specifically, the operator sets the blank BL on a drawing machine (not shown) having a die apparatus for preliminary forming 200 as shown in FIG. 2, and forms the preform 90 by operating the drawing machine.

The die apparatus for preliminary forming 200 is a die apparatus for forming the preform 90 by plastically deforming the plate-shaped blank BL and is mainly composed of a preliminary forming punch 210, a preliminary forming die 220, and an ejector pin 230. The preliminary forming punch 210 is a die for forming the tubular portion 91 and the sloping portion 92 by pressing a central portion of the blank BL. This preliminary forming punch 210 has a tapered portion which corresponds to the tubular portion 91 of the preform 90 and a dome-shaped portion which is located at the forward end of the tapered portion and which corresponds to the sloping portion 92.

The preliminary forming die 220 is a die which is disposed facing the preliminary forming punch 210 and forms the tubular portion 91 and the sloping portion 92 while supporting the blank BL pressed by the preliminary forming punch 210. This preliminary forming die 220 has a tapered through hole which corresponds to the tubular portion 91 and which allows the preliminary forming die 220 to receive the blank BL pressed by the preliminary forming punch 210 and form the tubular portion 91. The ejector pin 230 is a circular columnar die for ejecting the preform 90 having the tubular portion 91 and the sloping portion 92 formed thereon from the preliminary forming die 220.

The operator forms the preform 90 by setting the blank BL on the die apparatus for preliminary forming 200 and operating the unillustrated drawing machine. As a result, the operator can obtain, from the plate-shaped blank BL, the cup-shaped preform 90 having the tubular portion 91 and the sloping portion 92. Since the sloping portion 91 is formed to have a curved shape, the preform 90 can be formed while suppressing a reduction of the thicknesses of the tubular portion 91 and the sloping portion 92.

Next, in a third step, the operator forms the pressed component 80. Specifically, as shown in FIG. 3(A), the operator places the preform 90 formed by the second step in the forming die apparatus 100 and then operates an unillustrated press to start pressing the preform 90. The operator places the preform 90 such that the preform 90 is fitted onto the protrusion 134 of the piercing die 130. In the process of forming the pressed component 80, as shown in FIGS. 3(A) and 3(B), the press causes the holding body 110 and the piercing punch 120 to move toward the piercing die 130, whereby the pressed component 80 is formed through the following sub-steps 1 and 2.

Sub-step 1: The forming die apparatus 100 first cuts off an inner portion of the sloping portion 92 of the preform 90. Specifically, as shown in FIG. 3(A), the holding body 110 of the forming die apparatus 100 moves toward the piercing die 130 so that the outer fixing and supporting portion 112 presses the tubular portion 91 of the preform 90. As a result, the tubular portion 91 is sandwiched between and is fixedly supported by the outer fixing and supporting portion 112 and the inner fixing and supporting portion 132 of the piercing die 130. Subsequently, the piercing punch 120 of the forming die apparatus 100 moves toward the piercing die 130 so that the pressing portion 121 presses the sloping portion 92 of the preform 90 and the sloping portion 92 is cut by the outer cutting edge 122 and the inner cutting edge 135 of the piercing die 130. As a result, a circular inner portion of the sloping portion 92 of the preform 90 which includes the positioning hole 93 is cut off.

Sub-step 2: Next, the forming die apparatus 100 forms the corner portion 83 by plastically deforming the sloping portion 92 of the preform 90. Specifically, as shown in FIG. 3(B), after cutting off a portion of the sloping portion 92 of the preform 90, the forming die apparatus 100 causes the piercing punch 120 to further advance toward the piercing die 130 so as to bend the remaining portion of the sloping portion 92 toward the receiving portion 133 within the forming space FS surrounded by the holding body 110, the piercing punch 120, and the piercing die 130 and then compress the remaining portion of the sloping portion 92.

Since the portion of the sloping portion 92 remaining after the cutting operation in sub-step 1 (referred to below as the "remaining portion of the sloping portion 92") is curved, the remaining portion of the sloping portion 92 has a length greater than the width W of the annular forming space FS between the outer extension restricting portion 111 of the holding body 110 and the inner extension restricting portion 136 of the protrusion 134. Since plastic deformation of the remaining portion in the widthwise direction within the forming space FS is restrained by the outer extension restricting portion 111 and the inner extension restricting portion 136, the thickness of the remaining portion of the sloping portion 92 increases, i.e., the remaining portion of the sloping portion 92 is thickened as the remaining portion is pressed toward the receiving portion 133. Accordingly, the corner portion 83 is formed and the punched hole 84 is formed radially inward of the corner portion 83 in a state in which the sloping portion 92 of the preform 90 has an increased thickness. In the present embodiment, the corner portion 83, including a horizontal portion around the punched hole 84, is formed to have a thickness greater than that of the blank BL and that of the tubular portion 91 (which becomes the tubular portion 82).

Since the corner portion 83 is formed by bending the sloping portion 92 and then pressing it, it is possible to form the corner portion 83 while increasing its thickness with a smaller force compared with a conventional technique of forming a material by compression only. Also, since the corner portion 83 is formed by bending and pressing the sloping portion 29, the corner portion 83 can be accurately formed without causing folding of the material at the corner portion 83. When the sloping portion 92 is cut in sub-step 1 and when the corner portion 83 is formed in sub-step 2, the receiving and supporting body 137 disposed around the piercing die 130 supports the lower end of the tubular portion 91 of the preform 90.

The pressed component 80 is formed as a result of cutting of the sloping portion 92 in sub-step 1 and formation of the corner portion 83 in sub-step 2. Namely, the cutting of the sloping portion 92 in sub-step 1 and the formation of the corner portion 83 in sub-step 2 correspond to the corner portion-forming step of the present invention. After the step of forming the corner portion 83, the press causes the piercing punch 120 and the holding body 110 to move away from the piercing die 130 so that the forming die apparatus 100 is opened or brought into a state in which the formed pressed component 80 can be removed from the forming die apparatus 100. Accordingly, the operator removes the pressed component 80 from the opened forming die apparatus 100 to complete the process of forming the pressed component 80.

As can be understood from the above description of operation, in the pressed component-forming method according to the above-described embodiment, the preform 90 having the tubular portion 91 and the sloping portion 92 extending from one end of the tubular portion 91 is used. A portion of the sloping portion 92 is cut off, and the remaining portion is bent toward the piercing die 130 within the forming space FS and is then compressed so as to form the corner portion 83. Namely, in the pressed component-forming method according to the present invention, instead of pressing and crushing a portion (the sloping portion 92) of the preform 90 which becomes the corner portion 83 such that that portion (the sloping portion 92) plastically deforms while buckling, the remaining portion is pressed in a direction intersecting the direction in which the sloping portion extends so as to bend the remaining portion. Therefore, it is possible to form the corner portion 83 while increasing its thickness with a smaller force compared with the conventional technique. As a result, the forming die apparatus 100 and die equipment including the forming die apparatus 100 can be made small and simple.

The present invention is not limited to the above-described embodiment, and a variety of modifications can be made without departing from the object of the present invention. In the drawings referred to in the description of the following modified embodiments, elements identical with those of the above-described embodiment are denoted by the same reference numerals, and their description is omitted.

In the above-described embodiment, the forming die apparatus 100 is configured to form the pressed component 80 as a completed product by performing a cutting operation and a deforming operation on the preform 90. However, the forming die apparatus 100 may be configured to finish the preform 90 by performing a cutting operation and a deforming operation on the preform 90 so as to produce a pressed component 80 which is a semi-processed product which is almost completed as the pressed component 80. In this case, the operator finishes the almost completed pressed component 80 (semi-processed product) using an unillustrated die for finishing to thereby complete the pressed component 80.

In the above-described embodiment, the sloping portion 92 of the preform 90 extends from the tubular portion 91 while smoothly bending with a curved shape. However, the shape of the sloping portion 92 of the preform 90 is not limited to the shape employed in the above-described embodiment, and the sloping portion 92 may have any shape so long as the sloping portion 92 extends in a direction intersecting the direction of the width W of the forming space FS, namely, as long as it extends obliquely so that the portion of the sloping portion 92 remaining after the cutting operation has a length greater than the width W of the forming space FS. Accordingly, as shown in FIGS. 6(A) and 6(B), the sloping portion 92 of the preform 90 may extend in a straight line with an inclination.

In the above-described embodiment, the tubular portion 91 of the preform 90 has a tapered shape such that its diameter decreases toward the sloping portion 92. However, the shape of the tubular portion 91 of the preform 90 is not limited to the shape employed in the above-described embodiment, and the tubular portion 91 may have any shape so long as the tubular portion 91 has a tubular shape. Accordingly, as shown in FIGS. 6(B) and 6(C), the tubular portion 91 of the preform 90 may have the shape of a tube with a constant outer diameter. In this case, the forming die apparatus 100 is preferably configured to grip the tubular portion 91 of the preform 90 from opposite sides in the radial direction of the tubular portion 91.

Figure 6:
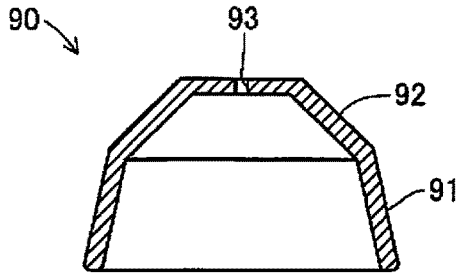
FIGS. 6(A) through 6(D) are cross-sectional views showing variations of the shape of the preform used in the pressed component-forming method according to modified embodiments of the present invention.
Figure 6:
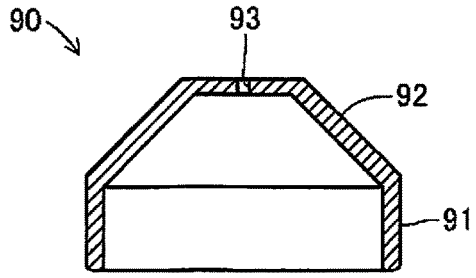
Figure 6:
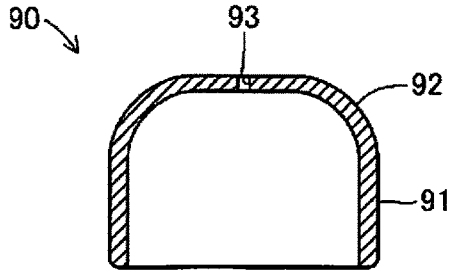
Figure 6:
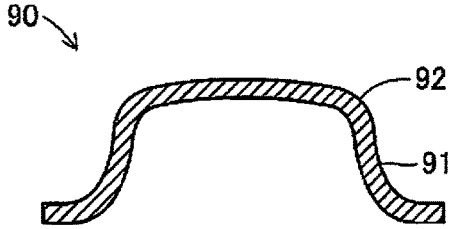
Figure 7:
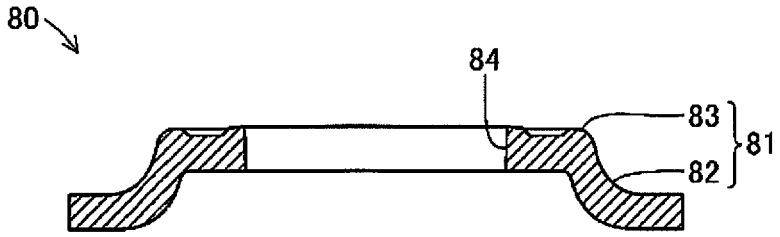
FIG. 7 is a cross-sectional view showing the shape of a pressed component according to a modified embodiment of the present invention.

Alternatively, as shown in FIG. 6(D), the preform 90 may have a bowl-like shape such that an end portion of the tubular portion 91 opposite the sloping portion 92 flares out to have a curved shape. In this case, a pressed component 80 formed from this preform 90 may have a bowl-like shape such that an end portion of the tubular portion 82 opposite the corner portion 83 flares out to have a curved shape.

In the above-described embodiment, the piercing die 130 of the forming die apparatus 100 has the die main body 131 for fixedly supporting the tubular portion 91 of the preform 90 and the protrusion 134 for cutting the sloping portion 92 of the preform 90, and the die main body 131 and the protrusion 134 are portions of a single member. However, the piercing die 130 may be configured such that the die main body 131 for fixedly supporting the tubular portion 91 of the preform 90 and the protrusion 134 for cutting the sloping portion 92 of the preform 90 are separate members. For example, the piercing die 130 may be configured such that the die main body 131 has the shape of a hollow cylinder having a through hole and the protrusion 134 slidably fits into the through hole of the die main body 131.

In the forming die apparatus 100 of the above-described embodiment, the piercing die 130 including the receiving and supporting body 137 is secured to a press, and the holding body 110 and the piercing punch 120 are provided so as to be movable relative to the piercing die 130. However, since the holding body 110 and the piercing punch 120 undergo relative movement with respect to the piercing die 130, these elements may of course be configured such that any one or two of the elements are movable and the remaining element(s) are stationary. For example, the piercing die 130 including the receiving and supporting body 137 may be configured to move relative to the holding body 110 and the piercing punch 120.

In the above-described embodiment, it is assumed that the pressed component 80 is a component which is used as a clutch guide, an end plate, a clutch piston, or a cup for a plate carrier of a clutch mounted on a vehicle such as an automobile or a motorcycle. However, the pressed component 80 may be a different type of part. This means that the pressed component-forming method according to the present invention may be applied to various pressed metal components 80 having a corner portion 83 at one end of a tubular body. The pressed component 80 is not limited to one having a circular cross section. It may have a so-called irregular shape, such as one with an elliptic or polygonal cross section (e.g., a triangular or quadrangular cross section).

In the above-described embodiment, the punched hole 84 of the pressed component 80 has a circular shape. However, the shape of the punched hole 84 is freely determined in accordance with the specifications of the pressed component 80 and is not limited to the shape employed in the above-described embodiment. Namely, the punched hole 84 of the pressed component 80 may have an elliptic shape, a polygonal shape (e.g., a triangular or quadrangular shape), a gear shape, a spline shape, or an irregular shape obtained by combining these shapes.

The material of the pressed component 80 may be a metal other than a steel plate made of SPCC, SPCD, SPCE, or the like which are particularly suitable for drawing. In particular, high-carbon steel or high-tensile steel, which are generally not suitable for drawing and stretch flanging, can also be precisely formed into the pressed component without causing forming failures such as breakage or cracking.

REFERENCES SYMBOLS

BL: blank, FS: forming space, W: width of the forming space

80: pressed component, 81: main body, 82: tubular portion, 83: corner portion, 84: punched hole,

90: pressed component, 91: tubular portion, 92: sloping portion, 93: positioning hole,

100: forming die apparatus,

110: holding body, 111: outer extension restricting portion, 112: outer fixing and supporting portion,

120: piercing punch, 121: pressing portion, 122: outer cutting edge,

130: piercing die, 131: die main body, 132: inner fixing and supporting portion, 133: receiving portion, 134: protrusion, 135: inner cutting edge, 136: inner extension restricting portion, 137: receiving and supporting body,

200: die apparatus, 210: preliminary forming punch, 220: preliminary forming die, 230: ejector pin.

The invention claimed is:

1. A method for forming a pressed metal component having a tubular body, one end of which is bent inward to form a cup-like shape, the method comprising:

preparing a preform having a tubular portion and a sloping portion which is provided at an end of the tubular portion and which slopes with respect to the tubular portion;

preparing a piercing punch which is disposed outside the sloping portion of the preform and which has an outer cutting edge for cutting off a portion of the sloping portion of the preform and a pressing portion for pressing the remaining portion of the sloping portion;

preparing a piercing die which is disposed inside the sloping portion of the preform and which has an inner cutting edge for cutting off the portion of the sloping portion in cooperation with the outer cutting edge, a receiving portion for receiving the sloping portion pressed by the pressing portion within a forming space between the receiving portion and the sloping portion, an inner extension restricting portion for restricting lengthwise extension of the sloping portion pressed by the pressing portion, and an inner fixing and supporting portion for fixedly supporting the tubular portion;

preparing a holding body which is disposed outside the sloping portion of the preform and which has an outer extension restricting portion for restricting lengthwise extension of the sloping portion pressed by the pressing portion and an outer fixing and supporting portion for fixedly supporting the sloping portion; and causing the piercing punch and the piercing die to move relative to each other in a state in which the preform is fixedly supported by the piercing die and the holding body so as to cut off the portion of the sloping portion and bend and press the remaining portion of the sloping portion to form a corner portion.

2. A method as claimed in claim 1 wherein the sloping portion of the preform extends from the tubular portion while bending smoothly in a curved shape.

3. A method as claimed in claim 1 wherein the tubular portion of the preform is tapered such that its diameter decreases toward the sloping portion.

4. A method as claimed in claim 1 including supporting an end of the tubular portion remote from the sloping portion with a support body on an exterior of the piercing die while pressing the remaining portion of the sloping portion with the piercing punch.

5. A method as claimed in claim 1 wherein the sloping portion of the preform as prepared includes a frustoconical region.

6. A method as claimed in claim 1 wherein the sloping portion of the preform as prepared includes a region which is curved as viewed in a longitudinal cross section of the preform.

7. A method as claimed in claim 1 wherein the tubular portion of the preform is cylindrical.

8. A method as claimed in claim 1 wherein the sloping portion of the preform as prepared includes a flat region which is normal to a longitudinal axis of the preform and which at least partially closes off an end of the preform.

9. A method as claimed in claim 1 wherein forming the corner portion comprises pressing the remaining portion of the sloping portion against the receiving portion of the piercing die.

10. A method as claimed in claim 1 wherein the pressing portion of the piercing punch has a convex portion, and pressing the remaining portion of the sloping portion forms an indentation in the corner portion with the convex portion of the pressing portion.

11. A method for forming a pressed metal component comprising:

disposing a hollow piercing punch having a cutting edge and a pressing portion outside of a preform having a tubular portion and a sloping portion at an end of the tubular portion which slopes with respect to the tubular portion and extends from the tubular portion towards a radial center of the preform;

disposing a piercing die inside the preform, the piercing die having a protrusion with a cutting edge for cooperating with the cutting edge of the piercing punch and a receiving surface surrounding the protrusion;

disposing the preform and the piercing die inside a bore of a holding body such that the tubular portion of the preform is held between an inner surface of the bore of the holding body and an outer surface of the piercing die and the preform extends over the protrusion of the piercing die; and with the tubular portion of the preform held between the inner surface of the bore of the holding body and the outer surface of the piercing die, producing relative movement of the piercing punch and the piercing die in an axial direction of the piercing die to cut off a portion of the sloping portion of the preform between the cutting edge of the piercing punch and the cutting edge of the protrusion and then press the pressing portion of the piercing punch against a remaining portion of the sloping portion of the preform which remains after cutting off the portion of the sloping portion to bend the remaining portion of the sloping portion towards the receiving surface of the piercing die and press the remaining portion into contact with the receiving surface of the piercing die and form a corner portion.

12. A method as claimed in claim 11 wherein pressing the remaining portion of the sloping portion of the preform into contact with the receiving surface of the piercing die plastically deforms the remaining portion and increases its thickness.

13. A method as claimed in claim 11 wherein the bore of the holding body extends between opposite sides of the holding body, the bore having a first region having an inner surface which contacts an outer surface of the tubular portion of the preform and a second region which surrounds the sloping portion of the preform, and producing relative movement of the piercing punch and the piercing die advances the piercing punch into the second region of the bore of the holding body.

14. A method as claimed in claim 11 wherein the piercing punch has a bore having the cutting edge of the piercing punch formed at an end of the bore of the piercing punch, and the portion of the sloping portion is cut off by inserting the protrusion of the piercing die into the bore of the piercing punch.

15. A method as claimed in claim 11 wherein an end of the tubular portion remote from the sloping portion abuts against a support body on an exterior of the piercing die when the remaining portion is being pressed by the piercing punch.

16. A method as claimed in claim 11 including confining the remaining portion of the sloping portion in a radial direction of the preform between the inner surface of the bore of the holding body and an outer peripheral surface of the protrusion of the piercing die while pressing the remaining portion of the sloping portion with the pressing portion of the piercing punch.

* * * * *